US011370133B2

(12) United States Patent
Hurwicz

(10) Patent No.: US 11,370,133 B2
(45) Date of Patent: Jun. 28, 2022

(54) SCREEN INSTALLATION TRIMMING TOOL

(71) Applicant: Maxim Hurwicz, Stanchfield, MN (US)

(72) Inventor: Maxim Hurwicz, Stanchfield, MN (US)

( * ) Notice: Subject to any disclaimer, the term of this patent is extended or adjusted under 35 U.S.C. 154(b) by 919 days.

(21) Appl. No.: 16/095,807

(22) PCT Filed: Apr. 27, 2017

(86) PCT No.: PCT/US2017/029766

§ 371 (c)(1),
(2) Date: Oct. 23, 2018

(87) PCT Pub. No.: WO2017/189803

PCT Pub. Date: Nov. 2, 2017

(65) Prior Publication Data

US 2020/0324423 A1 Oct. 15, 2020

Related U.S. Application Data

(60) Provisional application No. 62/328,127, filed on Apr. 27, 2016.

(51) Int. Cl.

| | |
|---|---|
| ***B26B 5/00*** | (2006.01) |
| ***B26B 29/02*** | (2006.01) |
| ***E06B 9/52*** | (2006.01) |

(52) U.S. Cl.

CPC ..... *B26B 5/005* (2013.01); *B26B 5/006* (2013.01); *B26B 29/02* (2013.01); *E06B 9/52* (2013.01)

(58) Field of Classification Search

CPC ..... B26B 5/005; B26B 5/006; B26B 29/02; E06B 9/52

See application file for complete search history.

(56) References Cited

U.S. PATENT DOCUMENTS

| | | | | |
|---|---|---|---|---|
| 3,153,853 | A * | 10/1964 | Lipton | B43M 7/002 30/294 |
| 3,448,519 | A * | 6/1969 | Tobias | B26B 5/005 374/E13.002 |
| 5,203,086 | A * | 4/1993 | Dann | B26B 29/06 30/162 |
| 6,226,824 | B1 * | 5/2001 | Hopson | B26B 5/001 81/488 |
| 7,305,729 | B2 * | 12/2007 | Dehner | B26B 5/003 30/162 |
| 9,227,310 | B2 * | 1/2016 | Wieland | B25B 27/14 |
| 2006/0144531 | A1 * | 7/2006 | Reiss-Schmidt | E06B 9/522 160/330 |

(Continued)

FOREIGN PATENT DOCUMENTS

| | | | | |
|---|---|---|---|---|
| JP | 2008231880 | * 10/2008 | ..... | B26B 27/00 |

OTHER PUBLICATIONS

Kaneko Nobuo; Cutting Tool e.g. Cutter Knife for Cutting; Oct. 2, 2008; EPO ENglish Machine Translation; pp. 1-6 (Year: 2022).*

(Continued)

*Primary Examiner* — Bayan Salone

(74) *Attorney, Agent, or Firm* — Sherrill Law Offices, PLLC

(57) ABSTRACT

A lightweight, handheld screen trimmer (10, 20, 30, 40) which aids in trimming excess screen (340) and also in removing, tucking in, and trimming spline (320). The screen trimmer (10, 20, 30, 40) assists in several tasks relating to removing, replacing and installing screening (330) in a screen frame (300).

21 Claims, 18 Drawing Sheets

(56) References Cited

U.S. PATENT DOCUMENTS

| | | | | |
|---|---|---|---|---|
| 2007/0033740 | A1* | 2/2007 | Dehner | B26B 11/00 7/158 |
| 2008/0235954 | A1* | 10/2008 | Radle | B26B 5/00 30/152 |
| 2012/0204394 | A1* | 8/2012 | Wieland | B25B 27/0092 29/278 |

OTHER PUBLICATIONS

Re-Screening a Damaged Window Screen' (Prime Line). Sep. 1, 2010. URL: <https://www.youtube.com/watch?v=hVYOofL4UEA?>.

How to Replace Screen Material' (DIY Network). Apr. 4, 2016. URL: <https://web.archive.orgweb/20160404214459/http://www.diynetwork.com/how-to/rooms-and-spaces/doors-and-windows/how-to-replace-screen-material>.

* cited by examiner

FIG. 3A
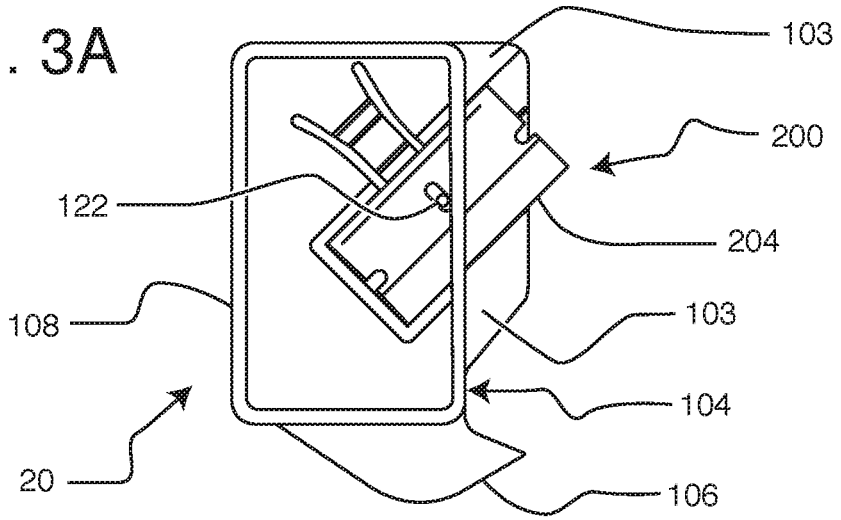
FIG. 3B
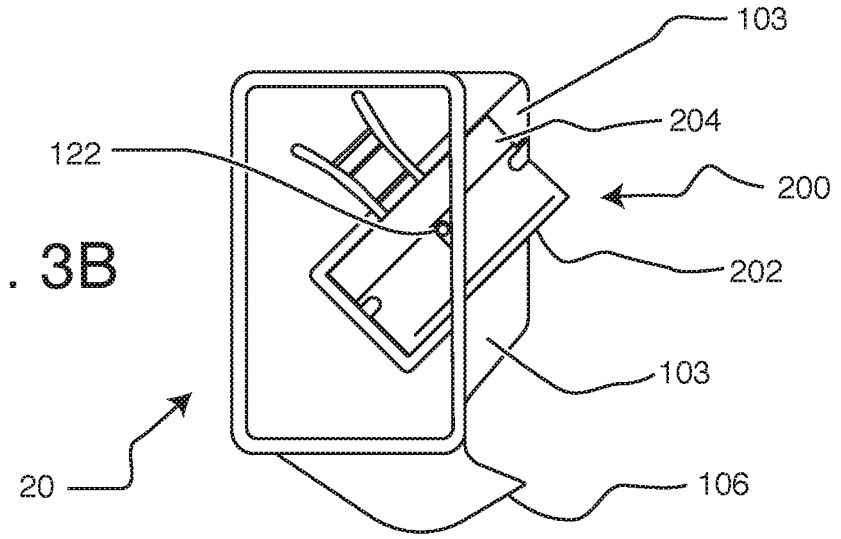
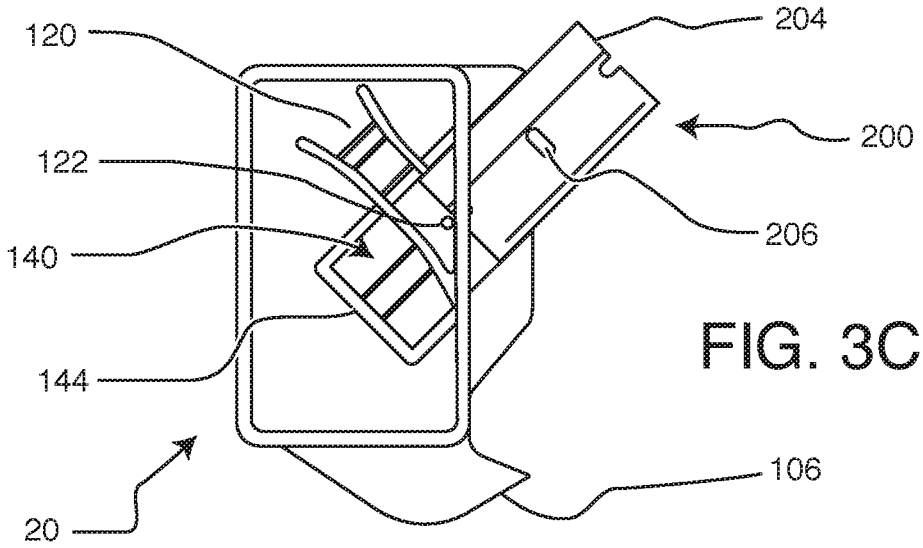
FIG. 3C

SCREEN INSTALLATION TRIMMING TOOL

FIELD OF THE INVENTION

The present invention relates generally to hand-held trimming knives of the type which utilize a razor blade for its cutting edge. More specifically, the invention relates to such a trimming knife which is specifically adapted for riding along two adjacent sides of a screen frame for trimming excess screen material.

BACKGROUND OF THE INVENTION

As the "do it yourself" movement grows, more people are doing repairs for themselves, such as repairing a torn window screen, instead of hiring a professional. As many people are repairing or building a screen for the first time, there is a need for a screen repair tool which does not require much skill or dexterity. Such a tool would perform its task in such a controllable manner that the DIYer would not need to worry about ruining the job. As many people perform such a task infrequently there is a need for an inexpensive tool. Similarly, even the professional has a need for a tool which helps them perform their job faster with less risk of damage.

SUMMARY OF THE INVENTION

The present invention has a primary object of providing a screen trimmer that will aid in overcoming difficulties associated with making or repairing framed screens.

Another object is to provide a screen trimmer that quickly and efficiently trims excess material, such as screening in a frame, without fear of damaging the center screen material, the frame or the frame's finish.

Another object is to provide a lightweight, handheld razor trimmer that can be comfortably and safely held, used and stored.

Another object is to provide a screen trimmer which performs a number of functions useful in making or repairing framed screens.

Another object is to provide a screen trimmer that requires little skill to use.

Another object is to provide a screen trimmer that is stabilized in more than one plane.

Another object is to provide a screen trimmer that guides the screen to the trimmer's cutting edge.

Another object is to provide a screen trimmer that saves time for the user.

Another object is to provide a screen trimmer that can be inexpensively manufactured.

The present invention is a lightweight, handheld screen trimmer which aids in trimming excess screen and also in removing, tucking in, and trimming spline. Thus the screen trimmer can assist in several tasks relating to removing, replacing or installing screening in a screen frame.

The present invention has several aspects, among which are stabilizing the tool in more than one plane, which contribute to accurately defining where the excess screen is trimmed lending the user more control and thus demanding less skill and helping the user to work faster and save time. This also makes it less likely to damage the center screen material. Another such aspect is positioning the blade cutting edge far enough out from the side guiding surface to be able to cut the excess screen, but not so far from the side guiding surface so as to cut the center screen. Another such aspect is the blade rides above the spline leaving it intact. Another such aspect is an optional blade cover guide to funnel excess screen to the blade cutting edge while preventing damage to the center screen and also increasing stability.

Another aspect of the present invention is a hook which functions to remove and tuck in spline while contributing added stability.

Also, when the tool's body is made of plastic or other similar materials it is less likely to scratch the frame's finished surface. Additionally the orientation of the blade prevents the blade cutting edge from damaging the frame or its finish.

There are many materials the tool can be made of, for example, plastic, rubber or metal. The examples of the versions presented in this disclosure are made of molded plastic (plus a razor blade), but this is not intended as a limitation as to the scope of suitable materials.

Additionally it is capable of being inexpensively manufactured. All the examples of versions presented in this disclosure are designed to be especially easily and economically manufactured, for instance, they were designed to have no overhangs.

The orientation of the blade cutting edge, various extents of covering the blade cutting edge, how the tool is held, storage of the blade and other varied aspects of versions of the invention contribute to increased safety while in use and when stored.

Other objects and advantages of the present invention will become obvious to the reader and it is intended that these objects and advantages are within the scope of the present invention.

A first embodiment of the invention is a manually operable insect screen removal and installation tool. The tool has a body and a sharp secured to the body. The body has transversely spaced upper and lower major surfaces defining a height, laterally spaced first and second edges defining a width, and (iii) longitudinally spaced third and fourth edges defining a length. The first edge defines a guide plane. The sharp extends laterally outward from the first edge of the body with the cutting edge of the sharp extending laterally orthogonal and longitudinally oblique relative to the guide plane.

A second embodiment of the invention is screen repair kit that include a tool in accordance with the first embodiment and at least one of insect screen, and insect screen spline.

A third embodiment of the invention is a method of installing insect screen onto screen frame using a tool in accordance with the first embodiment. The method includes the steps of (i) placing insect screen over a framed opening and peripheral spline channel defined by a screen frame, with excess insect screen extending beyond the periphery defined by the spline channel of the screen frame, (ii) pressing screen spline and associated insect screen into the spline channel in the screen frame so as to capture a periphery of the insect screen within the spline channel, and (iii) trimming excess insect screen from around the frame by (A) placing the excess insect screen projecting from the spline channel under tension, (B) pressing the first edge of the tool against an exterior edge of the screen frame with the sharp projecting towards and into operable slicing engagement with tensioned excess insect screen projecting from the spline channel, and (C) sliding the tool along the exterior edge of the screen frame with the first edge pressed against the exterior edge of the screen frame and the sharp projecting into and slicing tensioned excess insect screen projecting from the spline channel.

The screen spline is preferably pressed into the spline channel by pressing the screen spline towards the spline channel with a rounded outward facing edge of a tab on the tool.

A fourth embodiment of the invention is a method of repairing insect screen on a screen frame using a tool in accordance with the first embodiment. The method includes the steps of removing spent insect screen from the screen frame, and then installing replacement insect screen onto the screen frame. The step of removing spent insect screen from the screen frame includes the steps of (i) removing a length of spent insect screen spline from a spline channel of a screen frame using a point on the tool, (ii) pulling the balance of the spent insect screen spline from the spline channel on the screen frame, and (iii) separating the spent insect screen from the screen frame. The step of installing replacement insect screen onto the screen frame includes the steps of (a) placing replacement insect screen over the framed opening and peripheral spline channel defined by the screen frame, with excess replacement insect screen extending beyond the periphery defined by the spline channel of the screen frame, (b) pressing screen spline and associated replacement insect screen into the spline channel in the screen frame so as to capture a periphery of the replacement insect screen within the spline channel, and (c) trimming excess replacement insect screen from around the screen frame by (-) placing the excess replacement insect screen projecting from the spline channel under tension, (-) pressing the first edge of the tool against an exterior edge of the screen frame with the sharp projecting towards and into operable slicing engagement with tensioned excess replacement insect screen projecting from the spline channel, and (-) sliding the tool along the exterior edge of the screen frame with the first edge pressed against the exterior edge of the screen frame and the sharp projecting into and slicing tensioned excess replacement insect screen projecting from the spline channel.

As with the third embodiment, the screen spline is preferably pressed into the spline channel by pressing the screen spline towards the spline channel with a rounded outward facing edge of a tab on the tool.

To the accomplishment of the above and related objects, this invention may be embodied in the forms illustrated in the accompanying drawings, attention being called to the fact, however, that the drawings are illustrative only, and that changes may be made in the specific construction illustrated and described and still stay within the scope of the present invention.

BRIEF DESCRIPTION OF THE DRAWINGS

FIG. 3A is a perspective view of the bottom of the version of the invention with a removable blade with the blade guard out.

FIG. 3B is a perspective view of the bottom of the version of the invention with a removable blade with the blade cutting edge out.

FIG. 3C is a perspective view of the bottom of the version of the invention with a removable blade with the blade partly inserted.

DETAILED DESCRIPTION OF THE INVENTION INCLUDING A PREFERRED EMBODIMENT

Nomenclature Table

Figure 1A:
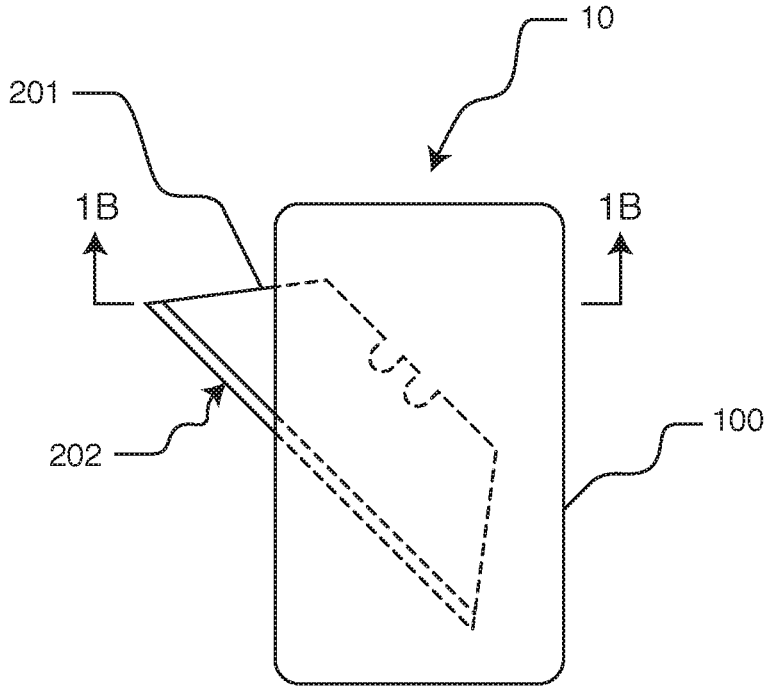
FIG. 1A is a top down view of the version of the invention with a fixed blade.

| REF. NO. | NAME |
|---|---|
| 10 | Trimmer (with fixed blade) |
| 20 | Trimmer (with removable blade) |
| 30 | Trimmer (with blade cover guide and extended top guiding surface) |

-continued

Nomenclature Table

| REF. NO. | NAME |
|---|---|
| 40 | Trimmer (mirror image of trimmer 20) |
| 100 | Body (blade retainer body) |
| 102 | Top guiding surface |
| 103 | Extended top guiding surface |
| 104 | Side guiding surface |
| 105 | Hook thickness |
| 106 | Hook |
| 107 | Hook point |
| 108 | Back Wall Support |
| 110 | Ear |
| 111 | Ear |
| 112 | Blade cover guide |
| 113 | Blade cover guide point |
| 114 | Opening (created by blade cover guide) |
| 120 | Tab |
| 122 | Pin |
| 124 | Button |
| 126 | Finger guard |
| 128 | Raised wall |
| 129 | Raised wall |
| 140 | Slot |
| 142 | Raised center strip |
| 144 | Slot retaining wall |
| 200 | Razor blade, single edge |
| 201 | Razor blade, utility |
| 202 | Blade cutting edge |
| 203 | Blade flat side |
| 204 | Blade guard |
| 206 | Blade center hole |
| 207 | Blade tip |
| 208 | Obtuse angle of blade |
| 209 | Acute angle of blade |
| 210 | Direction of motion of trimmer 10 |
| 211 | Direction of motion of trimmer 20 |
| 212 | Direction of motion of trimmer 30 |
| 213 | Direction of motion of trimmer 40 |
| 300 | Frame |
| 302 | Corner |
| 303 | Stile |
| 304 | Stile |
| 310 | Channel |
| 320 | Spline |
| 330 | Center screen |
| 340 | Excess screen |
| 350 | Frame top side |
| 360 | Frame outside |
| 370 | Horizontal plane |
| 380 | Vertical plane |
| 390 | Intersection (of horizontal plane 370 and vertical plane 390) |
| 400 | Digit (thumb or finger) |

Figure 1B:
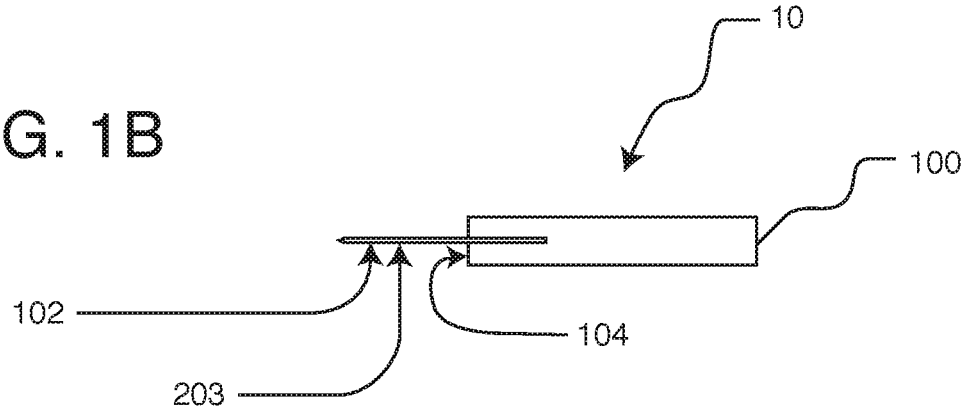
FIG. 1B is a sectional view taken along lines 1B-1B of FIG. 1A.
Figure 1C:
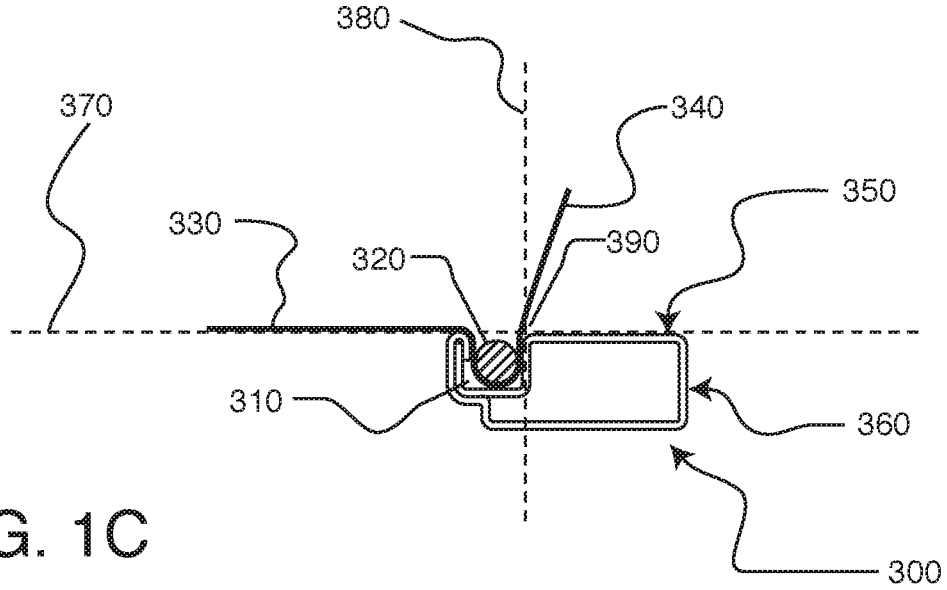
FIG. 1C is a cutaway view of a screen frame and its parts.
Figure 1D:
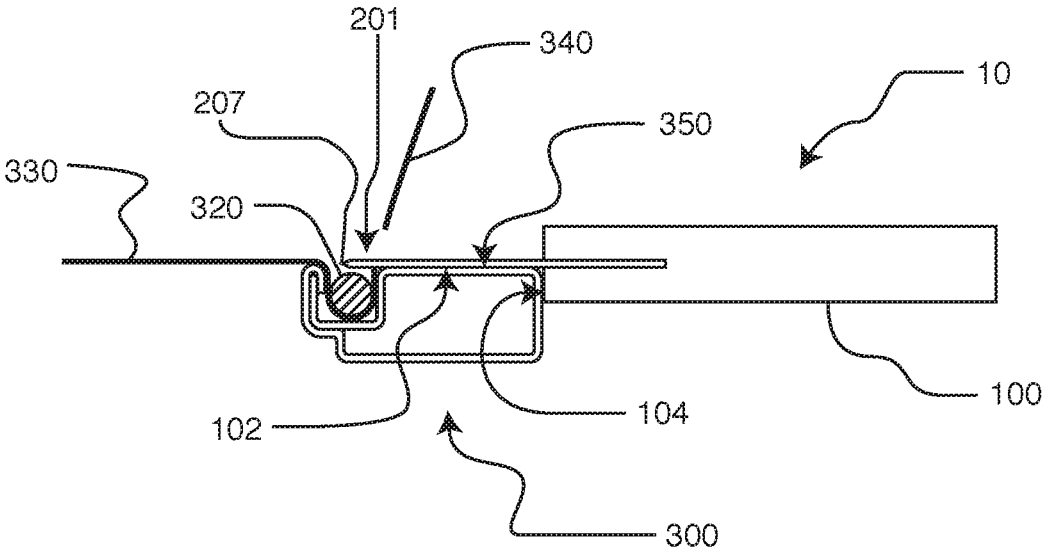
FIG. 1D is a cutaway view of a screen frame, its parts and the version of the invention with a fixed blade.

FIGS. 1A, 1B, 1D and 1E illustrate a handheld trimmer 10 for trimming an excess screen 340 which is captured in a frame 300, the trimmer 10 comprising a side guiding surface 104, a top guiding surface 102, a razor blade 201 in the same general plane as and adjacent to a frame top side 350, and a graspable blade retainer body 100 (elsewhere also referred to simply as the "body"). Trimmer 10 has the razor blade 201 molded into the blade retainer body 100. For the purpose of being comfortably handheld, the blade retainer body 100 is approximately 1.5" side to side (as measured perpendicular to the frame outside 360) and approximately 2.5" from front to rear (as measured parallel to the side frame outside 360) not including the protruding, exposed portion of the razor blade 201. In the example in FIG. 1E the blade 201 protrudes approximately 0.65" beyond side guiding surface 104 (as shown in FIG. 1D). The side guiding surface 104 is approximately 0.1" high. These dimensions can be adapted to accommodate, for instance, screen frames of different sizes. The dimensions given in this example simply reflect a common size screen frame.

As shown in FIGS. 1A, 1B, 1D and 1E, the screen trimmer 10 comprises the razor blade 201, and the blade retaining body 100 which together include two guiding surfaces, the top guiding surface 102 which rides adjacent and parallel to the frame top side 350 and the second side guiding surface 104 which rides adjacent and parallel to the frame outside 360. These two guiding surfaces are generally perpendicular and adjacent to each other. The top guiding surface 102 can simply be the blade flat side 203 of the razor blade 201 as particularly shown in FIG. 1B. As particularly shown in FIGS. 9A, 9B and 10, the top guiding surface 102 can also include additional extended top guiding surface 103 which offers advantageous functions such as to more firmly retain the blade 201, increase stability vis a vis frame top side 350 and protectively cover more of the blade cutting edge 202 of the blade 201. The razor blade 201 is positioned in the same general horizontal plane 370 as the frame top side 350 and is further positionally defined by reference to the side guiding surface 104 to trim excess screen 340 while not damaging the center screen 330 or the frame 300.

As shown in FIGS. 1A, 1B, 1D and 1E the screen trimmer 10 for trimming the excess screen 340 from the frame 300 which has the frame top side 350 and the frame outside 360, said trimmer 10 comprising the razor blade 201 at least partially retained by the blade retainer body 100 which includes the side guiding surface 104 relative to the frame outside 360 which is generally perpendicular to a blade flat side 203 of the blade 201 which functions as the top guiding surface 102 relative to the frame top side 350.

Figure 11:
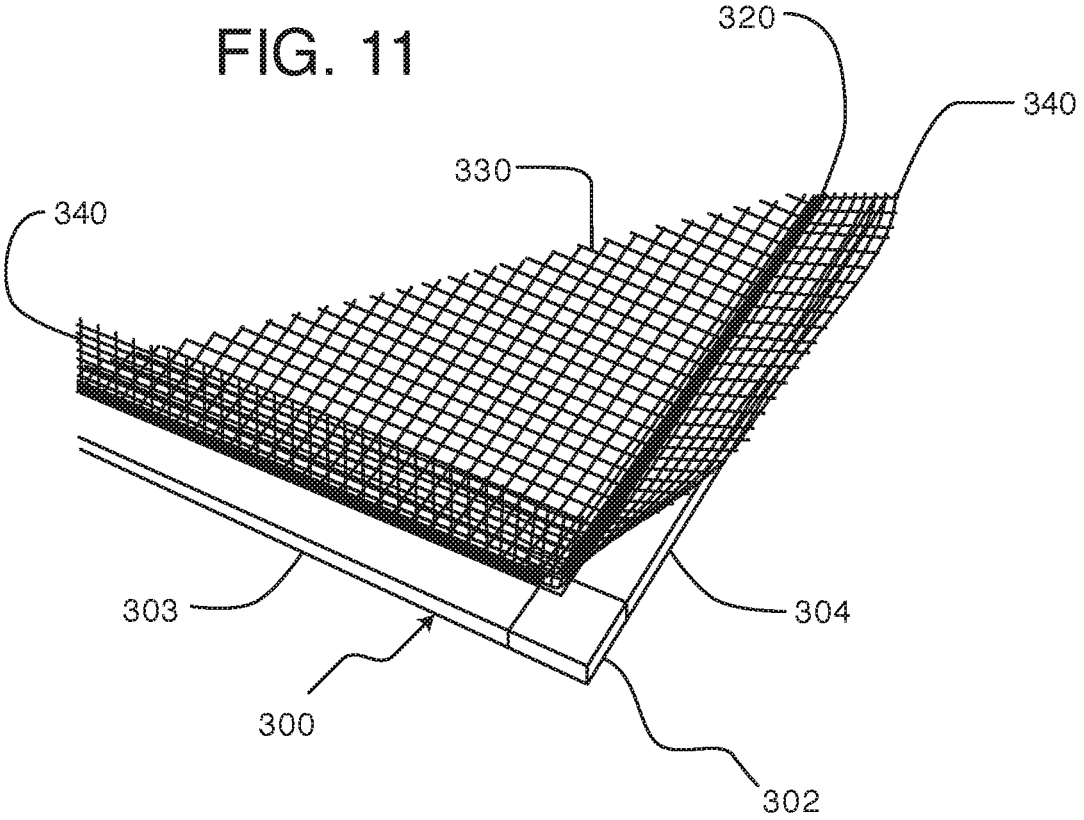
FIG. 11 is a top down view of a quadrant of a screen frame.

FIG. 1C shows a cutaway view of the screen frame 300 with a spline 320 locked into a channel 310 defining a center screen 330 and an excess screen 340. Also shown is a horizontal plane 370 and a vertical plane 380. The horizontal plane 370 is generally in the same plane as the frame top side 350 and the center screen 330. The vertical plane 380 is perpendicular to the horizontal plane 370 and in the same vertical plane 380 where the excess screen 340 emerges from the channel 310 and runs parallel to a frame outside 360. The intersection 390 of horizontal plane 370 and vertical plane 380 is the approximate desired location to cut off excess screen. As shown in FIG. 11, each side, composed, for example, of a stile 303 or a stile 304 with a corner 302 of the screen frame 300, will have its own such set of intersecting planes.

FIG. 1D shows the trimmer 10 trimming the excess screen 340. The excess screen 340 is shown floating above the blade 201 after it has been cut off. This cut is performed approximately at intersection 390 of the horizontal plane 370 and vertical plane 380 (as shown in FIG. 1C). By using the side guiding surface 104 as a reference the blade 201 is positioned to enable the cutting of the excess screen 340 but not cutting the center screen 330. The position of the side guiding surface 104 can be varied relative to blade tip 207 and blade cutting edge 202 (as shown in FIG. 1A) to accommodate situations where the excess screen 340 is at different distances from frame outside 360. The trimmer 10 can be designed so the blade 201 can be positioned such that the blade tip 207 (as shown in FIG. 1D) and blade cutting edge 202 protrudes more or less from the side guiding surface 104.

FIG. 1D also shows how the blade 201 rides above the spline 320 thus leaving the spline 320 intact.

Figure 1E:
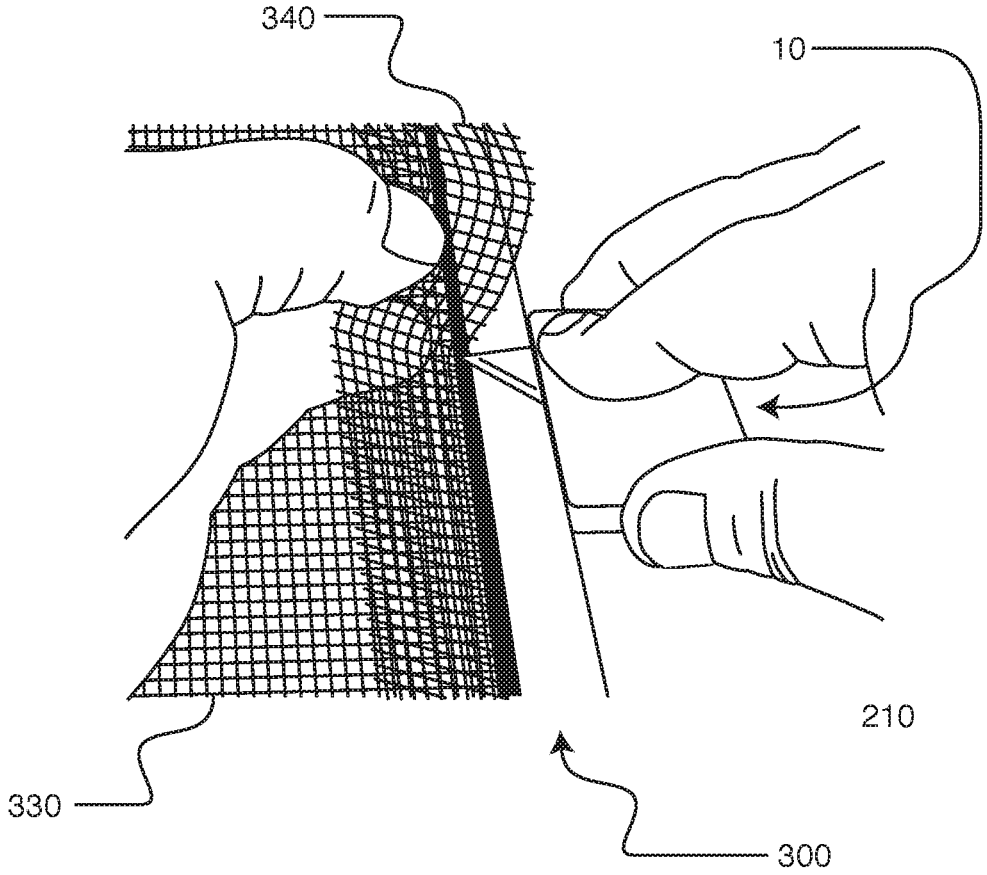
FIG. 1E is a perspective view of the version of the invention with a fixed blade as used to trim screen.

FIG. 1E shows the trimmer 10 in use trimming the excess screen 340 in a direction of motion 210 while leaving the center screen 330 intact. As shown in FIGS. 1C and 1D the trimmer 10 utilizes the top guiding surface 102 of the blade 201 held against the frame top side 350 to maintain the desired position in reference to the horizontal plane 370. One example of cutting while pulling on trimmer 10 is shown in FIG. 1E where a portion of the excess screen 340 is intact and part of the excess screen 340 has separated. FIG. 1D shows separated excess screen 340 floating after having been cut.

Figure 2A:
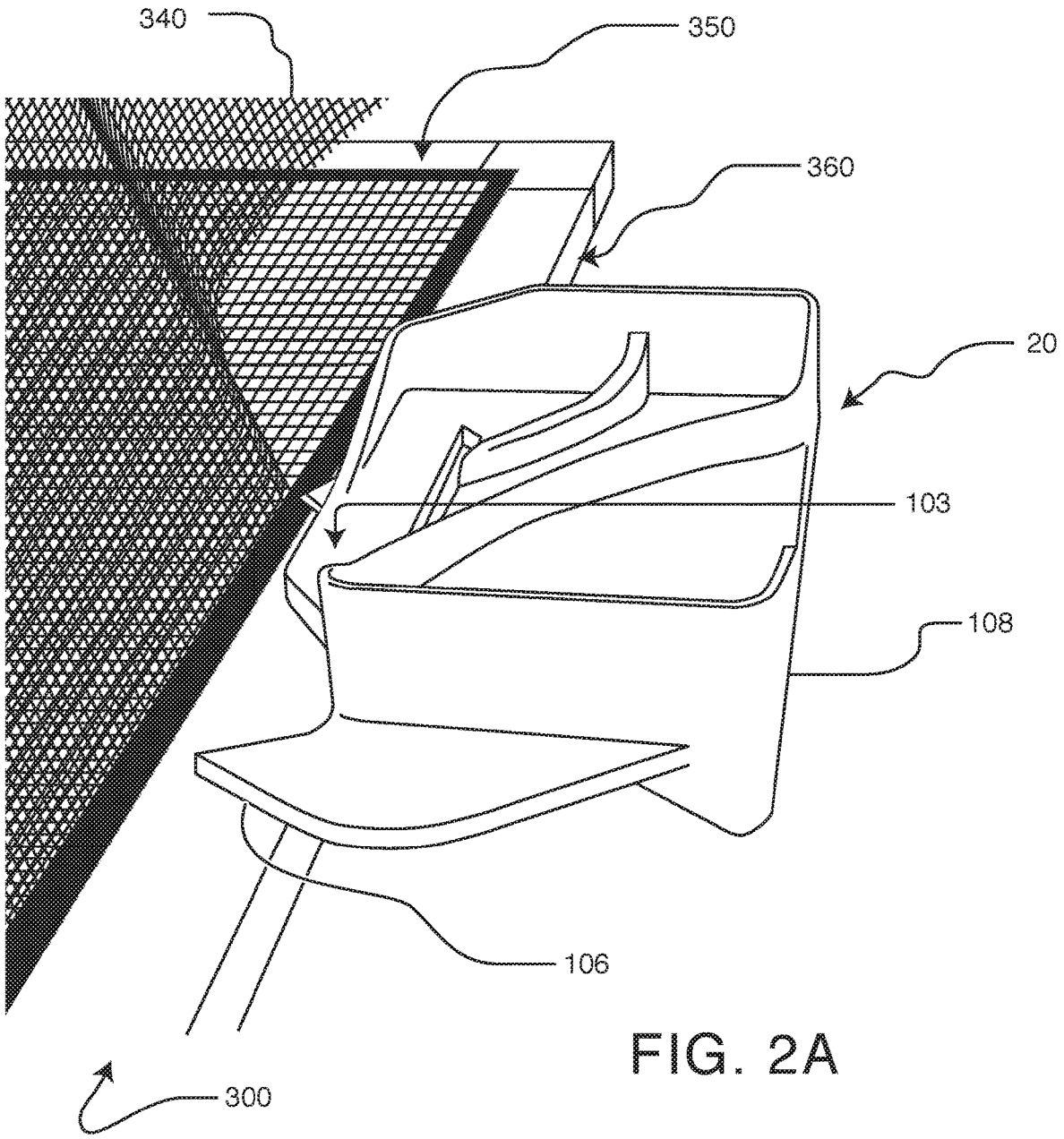
FIG. 2A is a perspective view showing details of the top side of the version of the invention with a removable blade as used to trim screen.
Figure 2B:
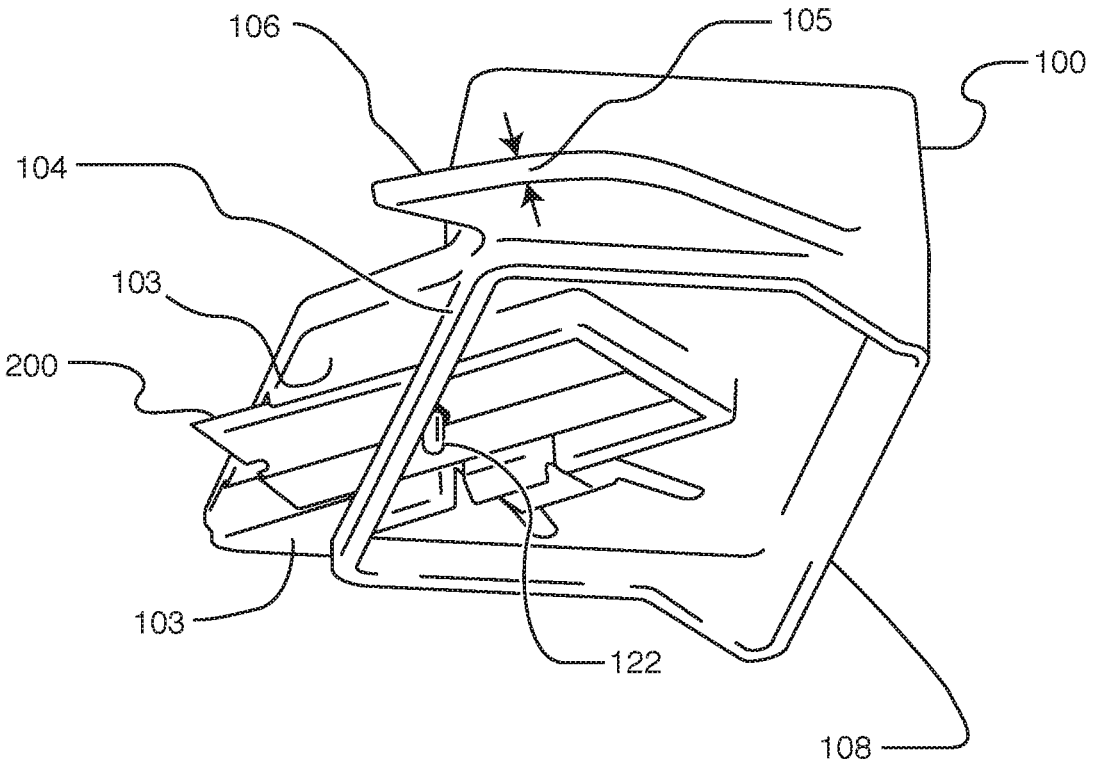
FIG. 2B is a perspective view showing details of the bottom side of the version of the invention with a removable blade.

FIGS. 2A and 2B show a second version of a trimmer 20 as positioned relative to the frame 300 for use in trimming the excess screen 340. Also shown is an optional back wall support 108 which functions to hold up top guiding surface 102 (as shown in FIG. 1B) and extended top guiding surface 103 (as shown is FIGS. 2B, 3A and 3B) in the horizontal plan 370 (as shown in FIG. 1C). The height of the back wall support 108 can be designed to match with different outside frame 360 heights. Additionally, the position of the back wall support 108 can be varied relative to the side guiding surface 104 bringing it closer to the frame outside 360. The designer may find it advantageous to anticipate any protuberances (not shown) that a frame 300 might present and position the back support wall 108 accordingly. Also, it is foreseen the back support wall 108 could be a different shape, such as simply being support columns (not shown).

Also shown in FIGS. 2A and 2B is a hook 106 which has multiple functions but FIG. 2A particularly shows how it contributes added stability vis-a-vis the frame top side 350. FIG. 2B helps to show the extended top guiding surface 103 as seen looking up from the bottom of the trimmer. The bottom side of the hook 106 can thus be thought of as an extension of the extended top guiding surface 103 in terms of added stability.

Figure 5A:
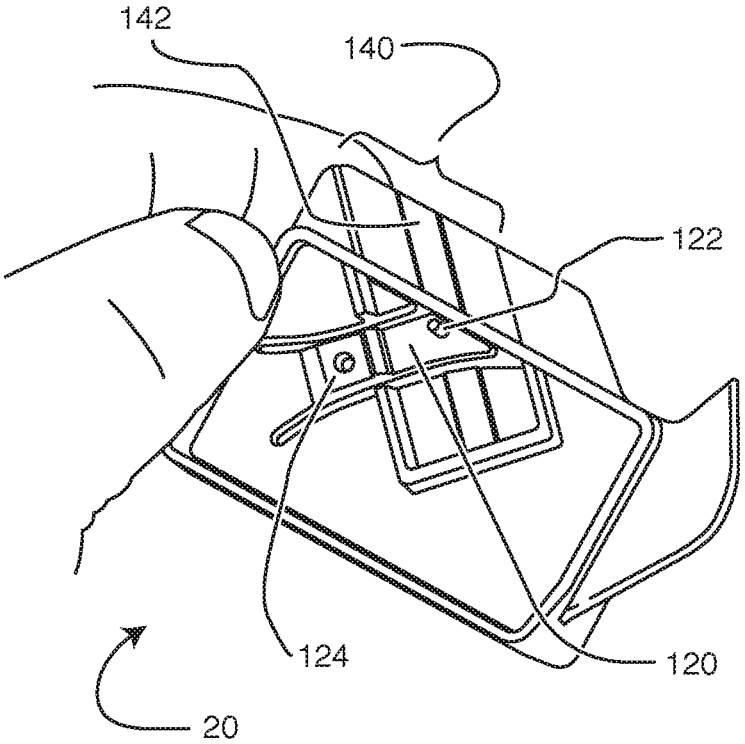
FIG. 5A is a top down view the bottom of the version of the invention with a removable blade with the tab in the default position.
Figure 5B:
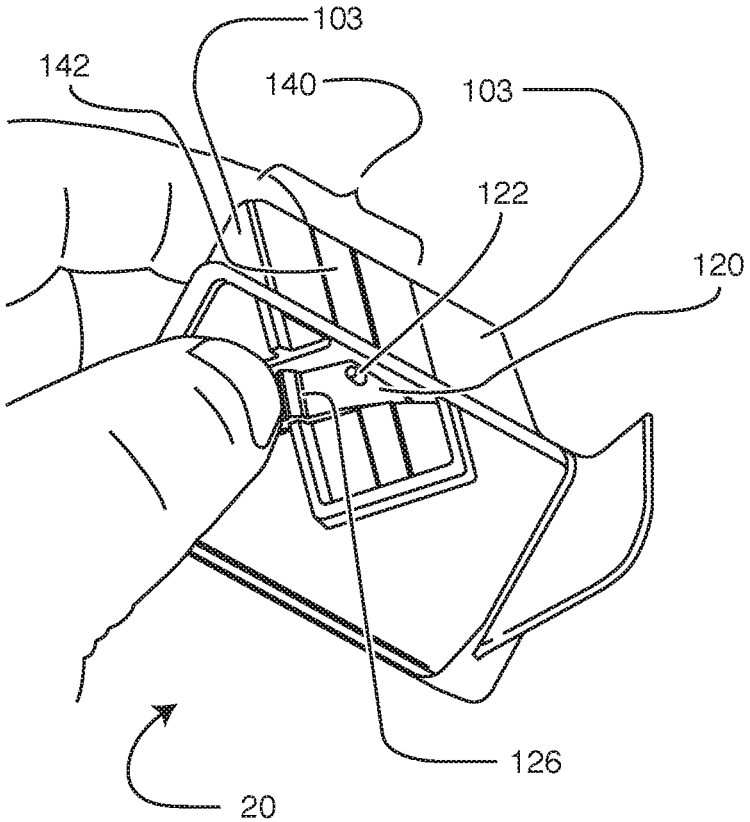
FIG. 5B is a top down view of the bottom of the version of the invention with a removable blade with the tab in the depressed position.

FIGS. 3A, 3B and 3C show the trimmer 20 with a slot 140 (shown in FIG. 3C and also FIGS. 5A and 5B) to accommodate a removable single edge razor blade 200. FIG. 3A shows the razor blade 200 in the slot 140 with a blade guard 204 exposed for safety. FIG. 3B shows the trimmer 20 with the razor blade 200 in the slot 140 with a blade cutting edge 202 exposed for use in trimming FIG. 3C shows a blade center hole 206 in the blade 200. A retaining pin 122 can be selectively moved up or down through the blade center hole 206 to release or retain the blade 200 (as shown in FIGS. 5A and 5B). When the pin 122 is withdrawn the blade 200 can be removed and replaced or flipped over. FIG. 3C shows the blade 200 partly inserted into (or partly removed from) the slot 140. As shown in FIG. 3C a slot retaining wall 144 both aids in defining the position of the blade 200 and protects the user from the blade's cutting edge 202.

There are many types of razor blades that could be used in this invention. They can vary, for example, in shape, in having one or more holes and/or notches or none at all, in having one or more edges sharpened and many other varying aspects. As shown in many figures, presenting the use of the utility blade 201 and the single edge blade 200 are simply two examples of such blades. It will be obvious one can adapt the design to accommodate such variations. For instance, instead of a tab 120 and the pin 122 combination shown in trimmer 20 in FIGS. 2A through 7C one could simply provide pressure on the blade via the shape of the tab to retain it without having a pin (not shown) or one could simply have a bump (not shown) instead of a pin. And the means of retaining the blade could be varied, for example, in location, orientation, size, shape of pin, and such to accommodate different blades. As shown in FIG. 7A, one advantage of the general design of this invention is the action of cutting the excess screen 340 pushes the blade 200 in towards the trimmer 20 so the blade 200 is more inclined to stay in the trimmer 20.

Also, there are many mechanisms for either holding or retaining a blade and/or advancing and withdrawing a blade which are well known and can be utilized and still be within the scope of the present invention (not shown).

One of the advantages of the versions shown, as for instance in FIGS. 1A and 2B, is they present a one-piece body 100 which is easier and cheaper to manufacture. One skilled in the art is free to choose from a variety of manufacturing methods, such as insert molding or later assembly. Also, it is obvious one could add more parts, such as a mechanism for retaining or advancing and withdrawing the blade, and still be within the scope of the present disclosure.

Figure 4:
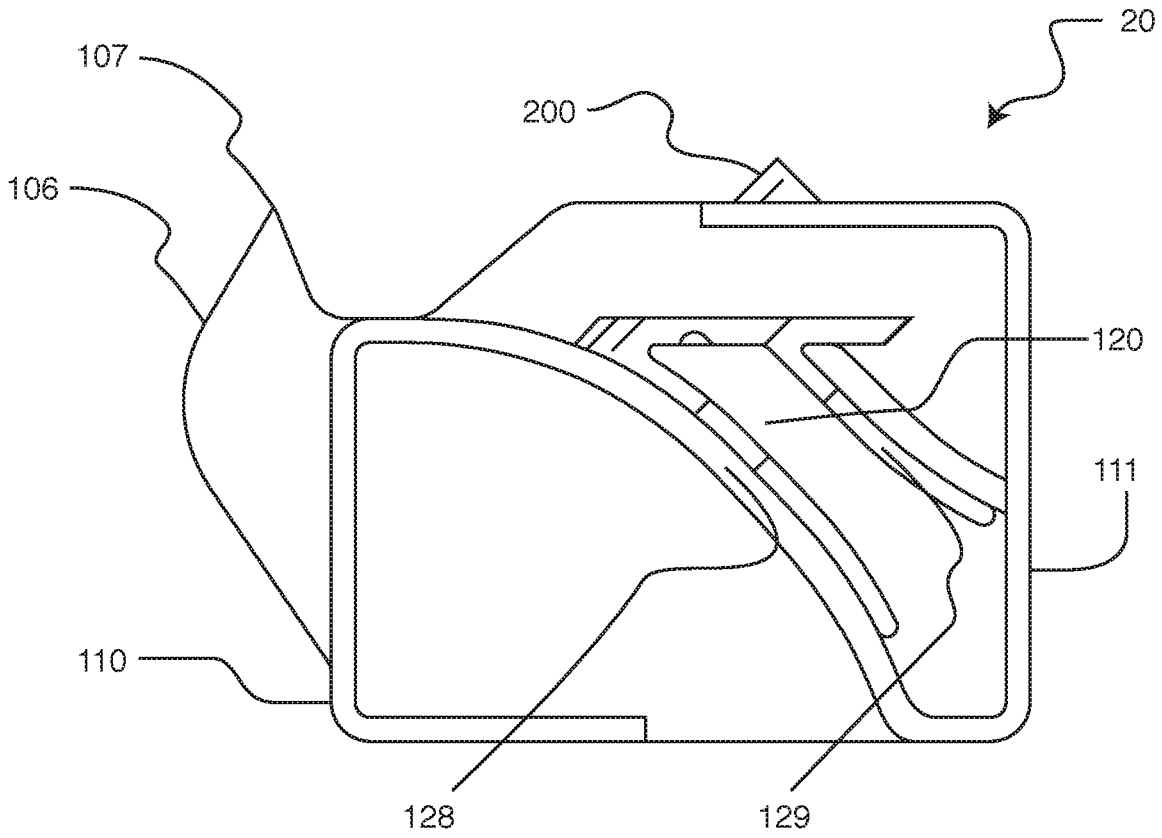
FIG. 4 is a top down view of the version of the invention with a removable blade.

FIG. 4 is a top down view of the trimmer 20 with a removable single edge razor blade 200. FIG. 4 shows an ear 110 and an ear 111 which make it easier and more comfortable to grip the trimmer 20 as shown in FIG. 7A. Also shown in FIG. 4 is the tab 120 which connects with the retaining pin 122 (as shown in FIGS. 5A and 5B). As shown in FIGS. 5A and 5B, the tab 120 is moved by pressing a button 124. FIG. 5A shows the tab 120 and the pin 122 in the default position where the pin 122 would be able to go through the blade center hole 206 (shown in FIG. 3C) to retain the blade 200 in the slot 140 if the blade 200 were present there as shown in FIGS. 3A and 3B. FIG. 5B shows the tab 120 depressed so the pin 122 is moved out of the way. When released the tab 120 returns to the default position. When the pin 122 is withdrawn the blade 200 can be slid in and out. As shown in FIGS. 3A and 3B the blade 200 can be inserted so that either the blade cutting edge 202 or the blade guard 204 is exposed. When the tab 120 is released the pin 122 slides through the blade center hole 206 thus holding the blade 200 in the slot. FIG. 4 also shows a raised wall 128 and a raised wall 129 which define a space for the tab 120 to move freely when the button 124 is pressed. In other words, when the button 124 is pressed with the digit 400 as shown in FIG. 5B, the user can form a grip by also pressing on the opposite side of the trimmer 20 with other digits (not shown) in which case the raised side wall 128 and the raised side wall 129 allow this grip while also providing a space for the tab 120 to move.

FIG. 5A shows the button 124 which, when pressed and released, moves the tab 120 and the pin 122 up and down. FIG. 5B shows the button 124 and tab 120 being depressed. Also shown in FIG. 5B is a finger guard 126 to prevent the user's digit 400 from contacting the blade cutting edge 202 as shown in FIG. 3A.

FIGS. 5A and 5B also show an optional raised center strip 142 which divides the slot 140 into three portions. The two portions of the slot 140 on either side of the raised center strip 142 are slightly wider than the width of the blade guard 204 (as shown in FIGS. 3A and 3B). Thus these three portions of the slot 140 aid in guiding the travel of the blade 200 into and out of the slot 140 and also helps to hold the blade 200 in position. Also the raised center strip 142 holds the blade 200 more adjacent to the frame top side 350.

Figure 6A:
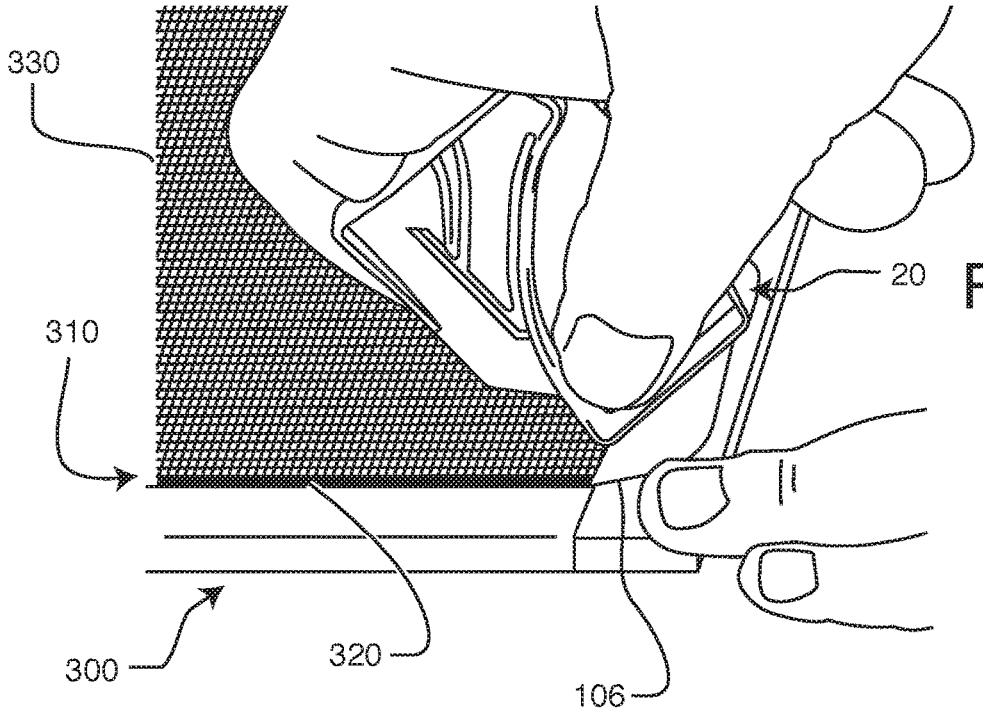
FIG. 6A is a perspective view of the version of the invention with a removable blade prying spline out of a screen frame's channel using the hook.
Figure 6B:
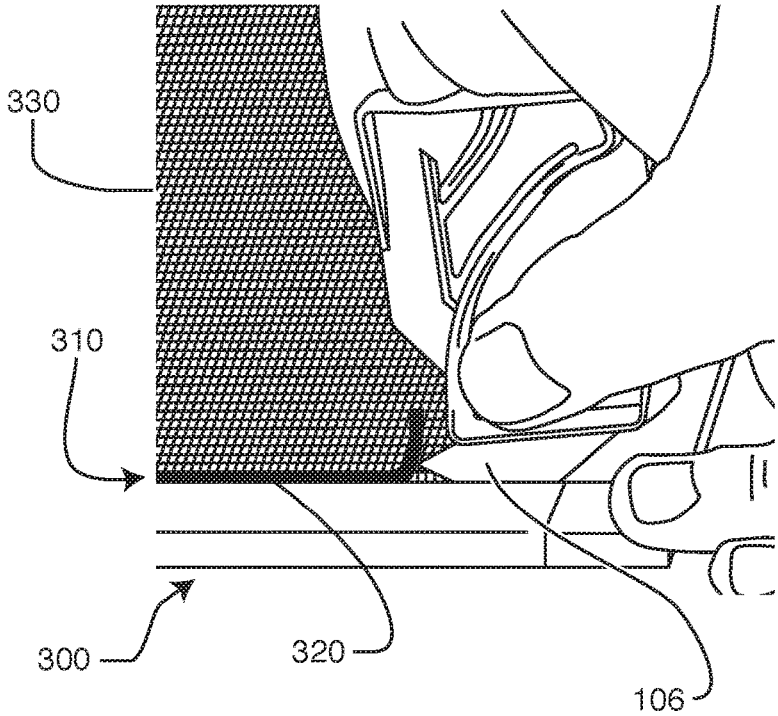
FIG. 6B is a perspective view of the version of the invention with a removable blade prying spline out of a screen frame's channel using the hook.
Figure 6C:
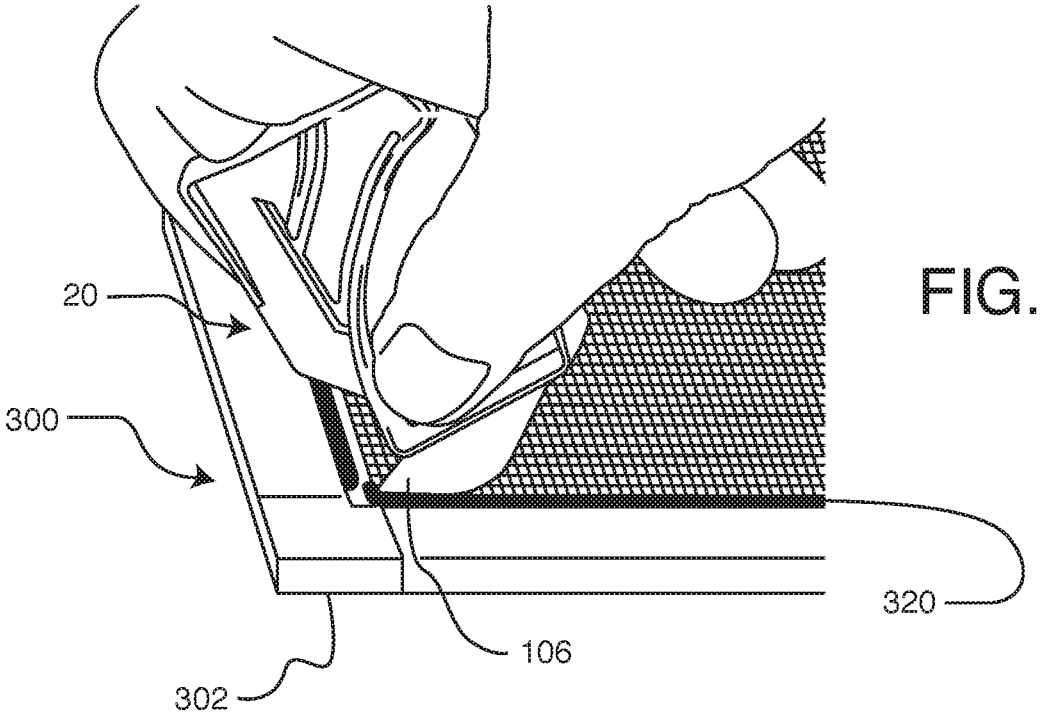
FIG. 6C is a perspective view of the version of the invention with a removable blade pressing spline into a screen frame's channel using the hook.
Figure 7A:
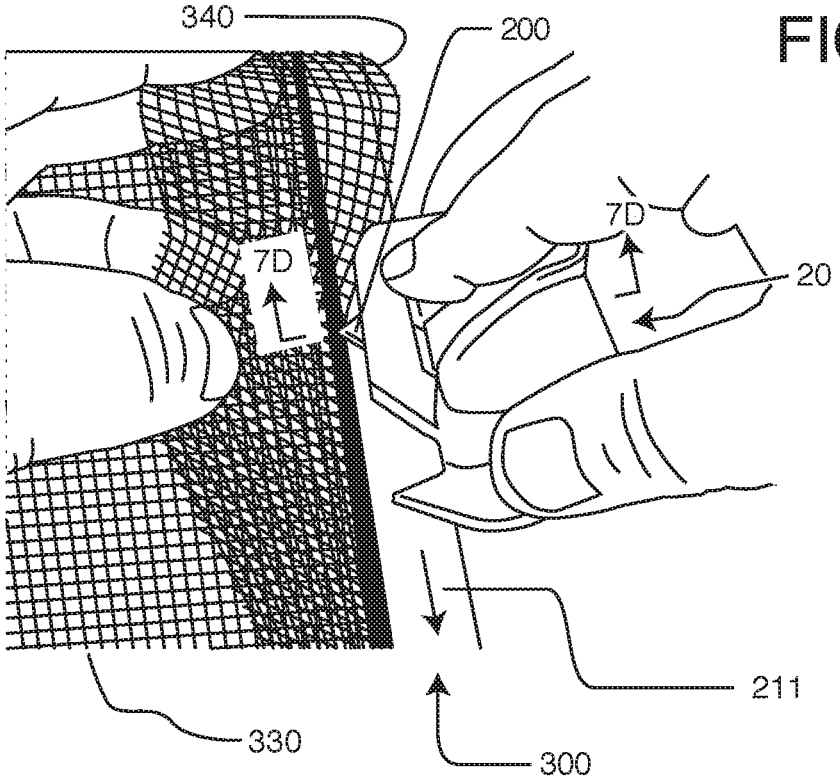
FIG. 7A is a perspective view of the version of the invention with a removable blade as used to trim screen.

FIGS. 6A and 6B show the hook 106 which can be used to pry the spline 320 out of the frame's channel 310. This is useful, for example, to aid in removing the spline 320 when replacing the center screen 330. The hook 106 is shaped to provide leverage when prying the spline 320 out of the channel 310. As shown in FIG. 6C the shape of the hook 106 also makes it easy to press down and roll over the spline 320 to tuck it into the channel 310 which is especially useful in a hard to reach spot such as the spline 320 in the corner 302. The hook 106 has a generally pointed hook point 107 (as shown in FIG. 4) allowing it to reach into small spaces to pry the spline 320 out as shown in FIG. 6A. The hook thickness 105 (as shown in FIG. 2B) should be sized to be able to fit into the frame's channel 310, also taking into account reduced width of channel 310 due to the center screen 330 and also any possible narrowing of the channel 310 at the corner 302 of the frame 300.

Figure 6D:
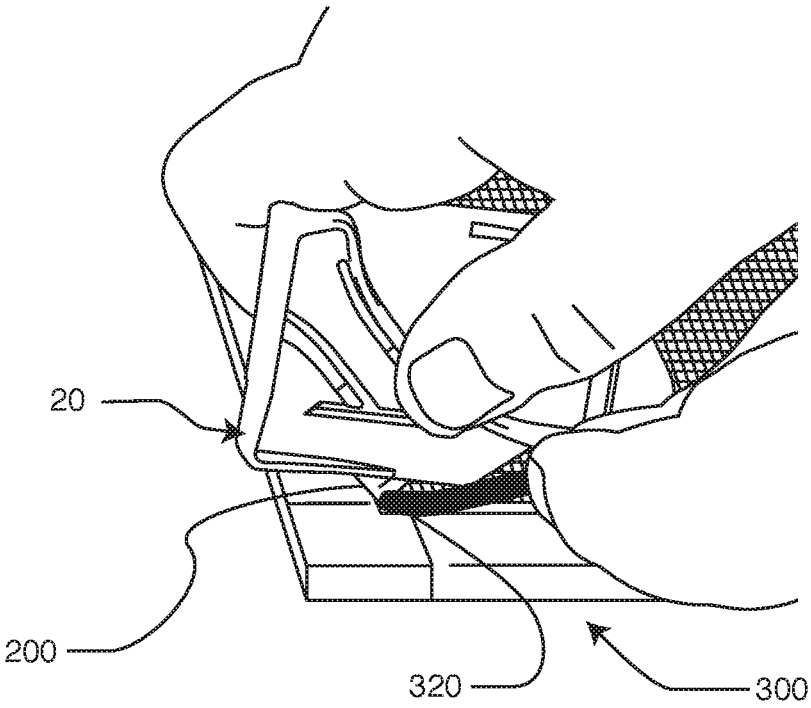
FIG. 6D is a perspective view of the version of the invention with a removable blade cutting spline.

FIG. 6D shows cutting the spline 320 with the blade 200 of the trimmer 20. This is another handy function of the present invention.

FIG. 7A shows the trimmer 20 in use trimming the excess screen 340 by pulling in the direction of motion 211. As shown in FIG. 7D the top guiding surface 102 of the trimmer 20 is held adjacent to the frame top side 350 and the side guiding surface 104 of the trimmer 20 is held adjacent to the frame outside 360 so the blade 200 trims the excess screen 340. Then, maintaining the relationship between the top guiding surface 102 and the side guiding surface 104 of the trimmer 20 with the frame 300, one moves the trimmer 20 along the frame 300 thereby trimming off the excess screen 340.

Figure 7B:
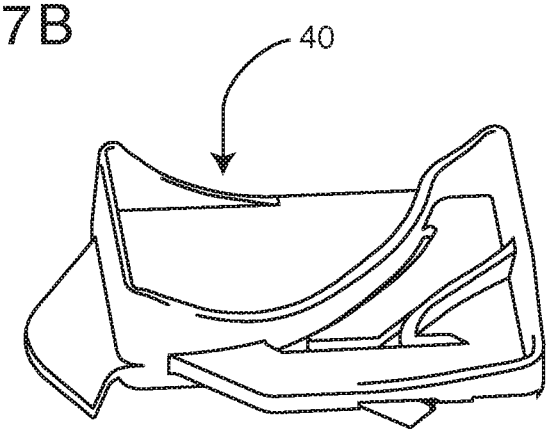
FIG. 7B is a perspective view of a mirror image of the version of the invention with a removable blade as shown in FIG. 7A.
Figure 7C:
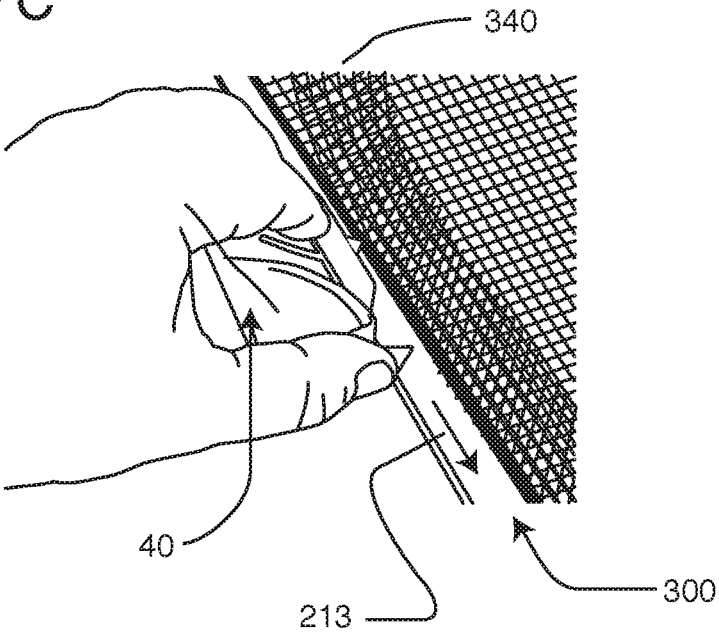
FIG. 7C is a perspective view of a mirror image of the version of the invention with a removable blade as shown in FIG. 7A trimming excess screen.
Figure 7D:
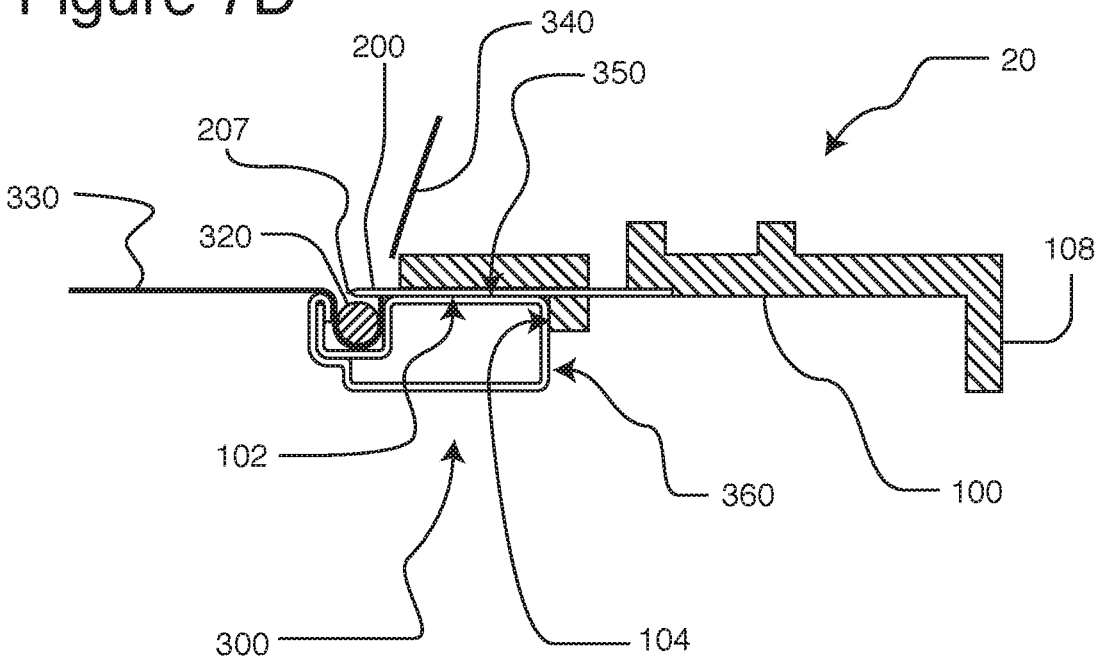
FIG. 7D is a sectional view taken along lines 7D-7D of FIG. 7A.

FIGS. 7B and 7C show a version of trimmer 40 which trims the excess screen 340 in direction of motion 213 which is the opposite of that seen with the trimmer 20 (as shown in FIG. 7A). A variation such as the trimmer 40 could be of advantage, for instance, for a left-handed person. Such variations are foreseen and are obvious to anyone skilled in the arts. Similarly the trimmer 10 as shown in FIGS. 1A, 1B, 1D and 1E cuts when pushed or pulled simply by changing its orientation appropriately. These examples of orientations are not intended to be exclusionary but are merely illustrative examples and these and other alternative orientations are within the scope of the present disclosure.

Figure 8A:
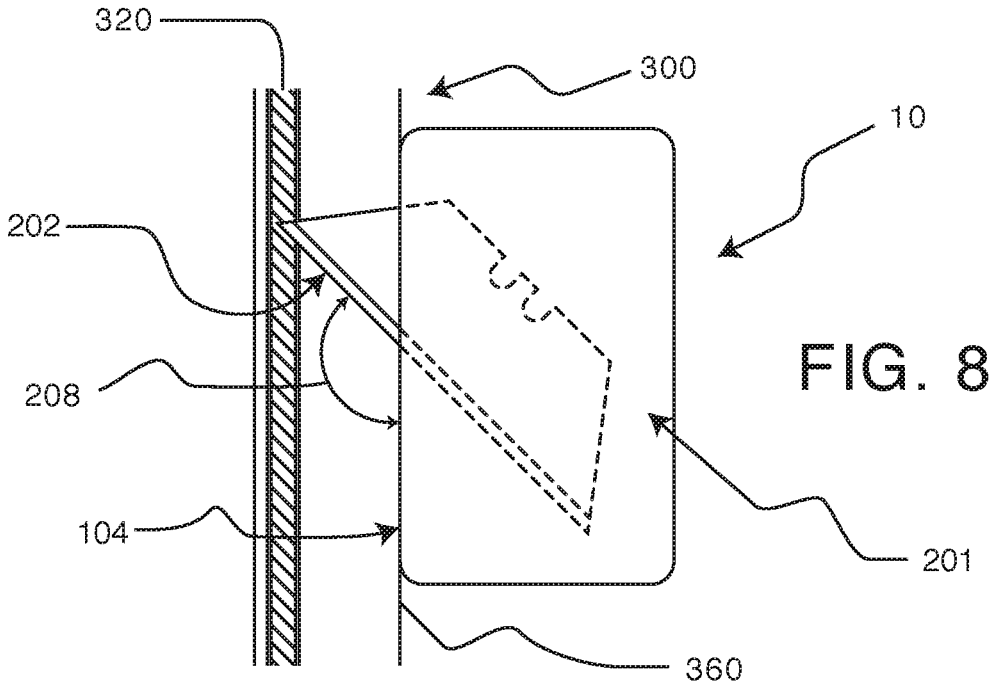
FIG. 8A is a top down view showing an obtuse angle of the cutting edge of the blade relative to the side guiding surface. For clarity the screen is not shown.

FIG. 8A shows an example of the trimmer 10 where the blade cutting edge 202 is at an obtuse angle 208 relative to the side guiding surface 104. In this example the blade cutting edge 202 is at an obtuse angle 208 of approximately 135 degrees relative to the side guiding surface 104. The obtuse angle 208 can be varied to between approximately 120 degrees and 160 degrees. The angles that razor blades cut better or worse at is well known so these ranges are given by way of example only.

In such a situation as shown in FIG. 8A one pulls the trimmer 10 while in use. Trimmer 10 can be flipped over and used with a pushing motion as the body 100 actually will have a side guiding surface 104 regardless of which way it is oriented. Other such variations in orientation of the trimmer 10 vis a vis the frame 300 can easily accommodate different usage requirements, such as between left-handed and right-handed usage.

Figure 8B:
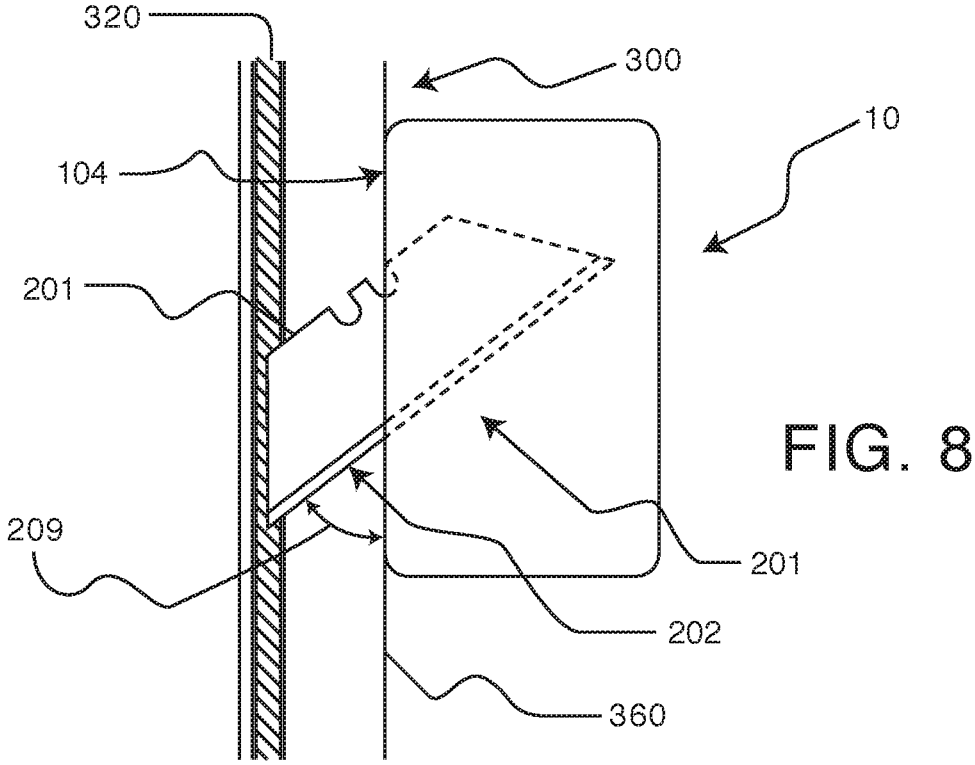
FIG. 8B is a top down view showing an acute angle of the cutting edge of the blade relative to the side guiding surface. For clarity the screen is not shown.

FIG. 8B shows an example of an acute angle 209 of the blade cutting edge 202 relative to the side guiding surface 104. In this example the blade cutting edge 202 is at the acute angle 209 of approximately 45 degrees relative to the side guiding surface 104. The acute angle 209 can be varied to between approximately 15 degrees and 65 degrees. The angles that razor blades cut better or worse at is well known so these ranges are given by way of example only.

The blade tip 207 and the exposed portion of the cutting edge 202 of the blade 201 as shown in FIGS. 1A, 1B, 1D and 1E and FIGS. 8A and 8B could have a selectively removable cover (not shown). Such covers are well known to those skilled in the art.

Figure 9A:
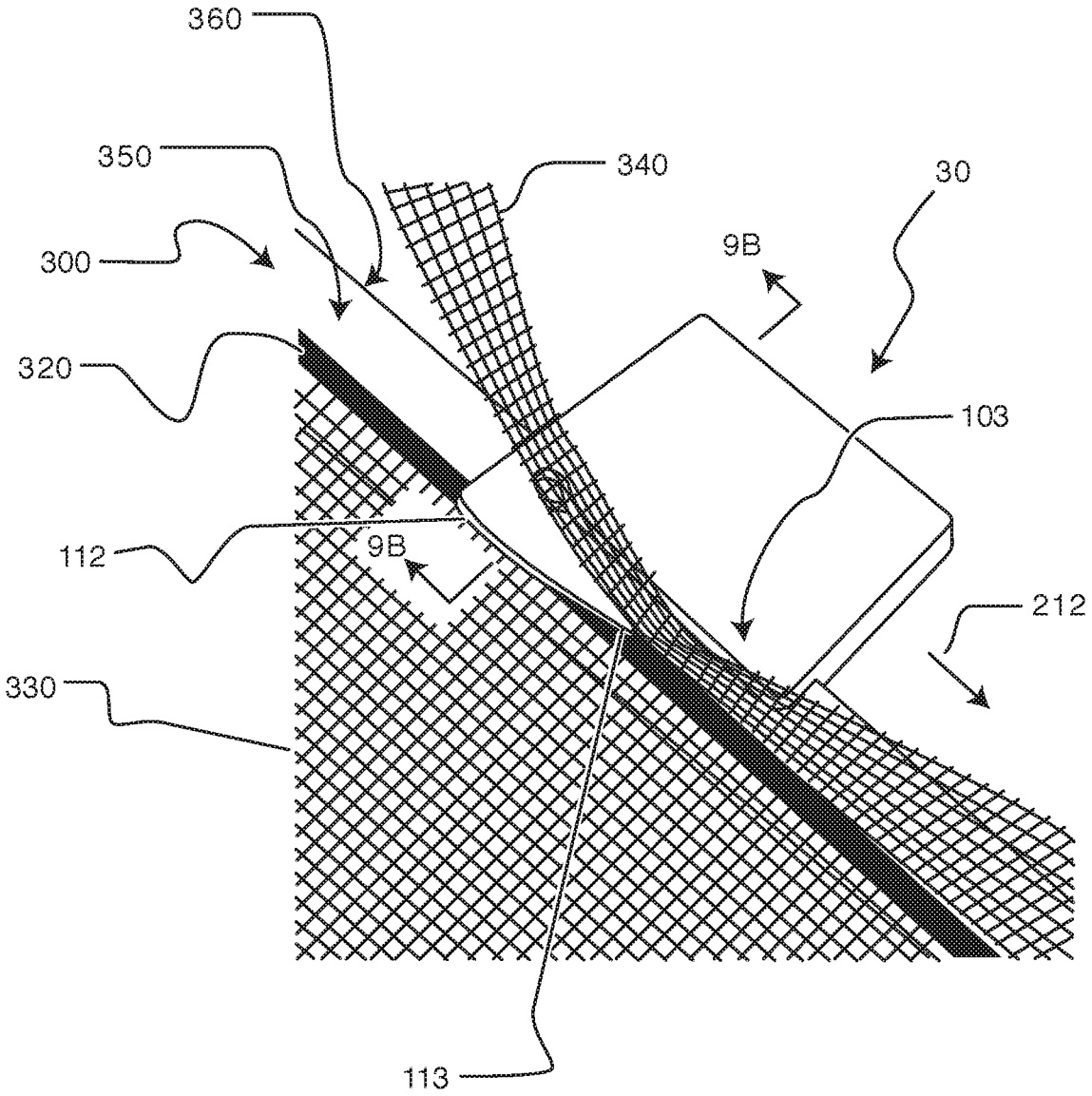
FIG. 9A is a perspective view of the version of the invention with a blade cover guide funneling the excess screen to the blade's cutting edge.
Figure 9B:
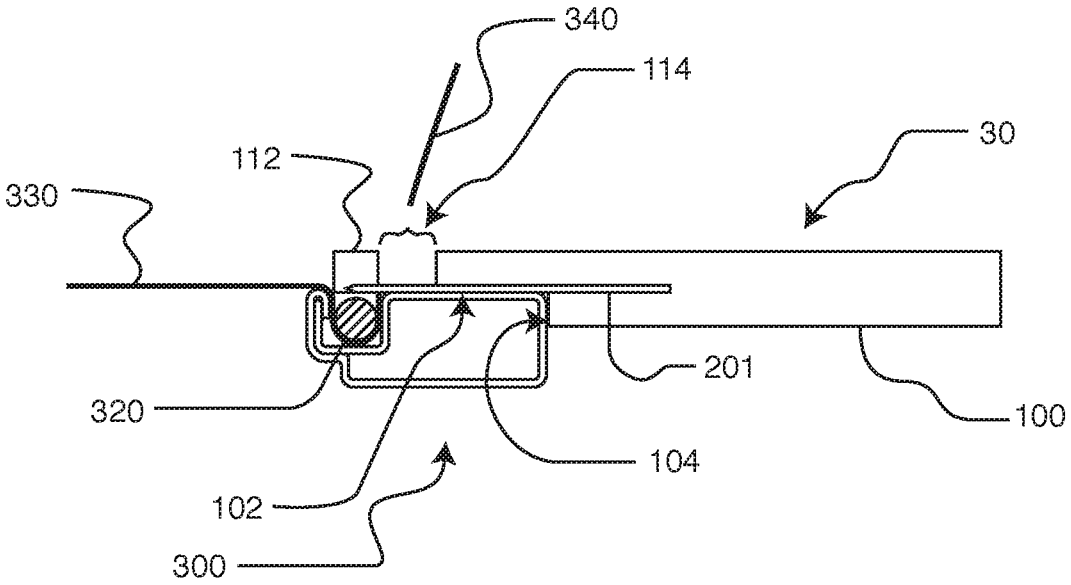
FIG. 9B is a sectional view taken along lines 9B-9B of FIG. 9A.
Figure 10:
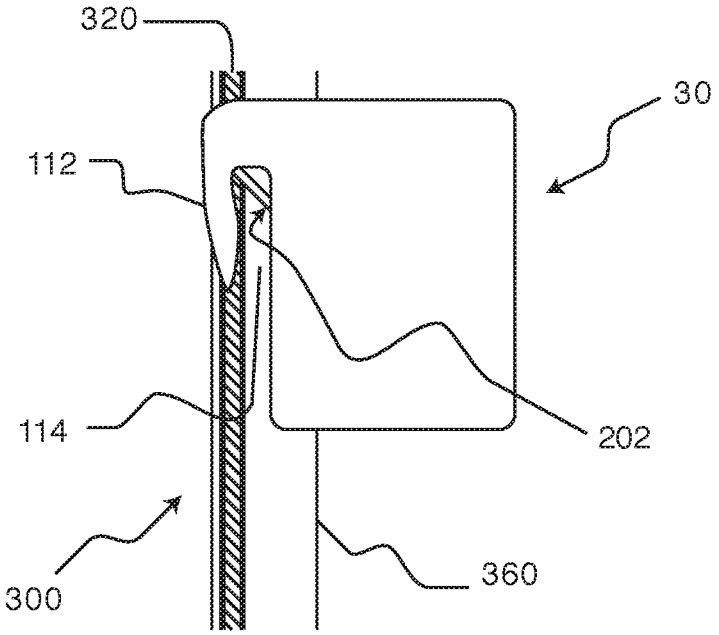
FIG. 10 is a top down view of the version of the invention shown in FIG. 9A.

FIGS. 9A through 10 show a trimmer 30 with a blade cover guide 112 in use trimming excess screen 340 by pulling in the direction of motion 212. The blade cover guide 112 can funnel the excess screen 340 to be presented to the blade cutting edge 202 of the blade 201. The blade cutting edge 202 is shown at an obtuse angle relative to the side guiding surface 104, but could be at the acute angle 209 as shown in FIG. 8B and described elsewhere in this disclosure. The blade cover guide point 113 can pierce excess screen 340 which is useful, for instance, when starting a cut. The blade cover guide 112 and extended top guiding surface 103 increase safety by covering more of the blade 201 while also providing increased stability vis a vis the horizontal plane 370.

FIG. 9B shows in cross section how the trimmer 30 cuts off the excess screen 340. The blade's top guiding surface 102 and the blade cutting edge 202 (shown in FIG. 10) is adjacent to the intersection 390 (as shown in FIG. 1C). An opening 114 created by the blade cover guide 112 serves to funnel the excess screen 340 to be presented to the blade cutting edge 202. The blade cover guide 112 covers more of the blade 201 which serves to protect the user from contact with the blade cutting edge 202 and also protects the center screen 330.

FIG. 10 is a top down view of the trimmer 30 with the excess screen 340 not shown for clarity, for example, to avoid obscuring the blade cutting edge 202. The excess screen 340 is shown in FIGS. 9A and 9B.

FIG. 11 shows a top left quadrant of the frame 300 composed of the stile 303 and the stile 304, a corner 302, the spline 320, the center screen 330 and the excess screen 340.

There are many variations that can be pursued and still remain within the scope of the present invention. Some examples of these variations include using blades of various shapes and sizes, having a mechanism for withdrawing and advancing the blade (not shown), having different means of retaining the blade such as even a simple screw (not shown), varying dimensions of the top guiding surface 102 and side guiding surface 104 (as shown in FIG. 1D), varying the distance from the side guiding surface 104 to the blade tip 207 (as shown in FIG. 1D), and other such changes can be made while still staying within the scope of the present invention. Also the raised ears 110 and 111 could be shaped differently and/or made a different size or even be absent as shown, for example, in FIG. 1A. Such examples of optional variations in design or features are foreseen and are within the scope of the present invention and are not intended to be exclusionary.

The designer can choose how many of the optional functions to include or leave out, for instance, the hook 106 (as shown in FIG. 2A), the blade cover guide 112 (as shown in FIG. 9A) or back support wall 108 (as shown in FIG. 2A) and still be considered to be within the scope of the present invention.

Also, although the present disclosure includes functional descriptions, such as being drawn towards oneself, it is obvious one could make a version, for instance, where the blade is positioned and/or designed to be used to cut while moved away from oneself or even sideways. Another such example is one may choose to use the device in a back and forth or sawing motion as opposed to strokes in a single direction. Also, if a blade is used which has a two cutting edges exposed (not shown) one could cut in either direction when pushing or pulling the device. Such functional descriptions are made by way of example and are not intended to be exclusionary.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, other suitable modifications and equivalents may be resorted to, that still fall within the scope of the invention.

I claim:

1. A manually operable insect screen removal and installation tool customized for cutting excess screen from a matched type of screen frame, comprising:

(a) a body having (i) transversely spaced upper and lower major surfaces defining a height, (ii) laterally spaced first and second edges defining a width, and (iii) longitudinally spaced third and fourth edges defining a length, wherein the first edge defines a guide plane, and (b) a sharp secured to the body with a cutting edge extending laterally outward from the first edge of the body, with the cutting edge having a distal tip and extending transversely orthogonal and longitudinally oblique relative to the guide plane, (c) wherein the cutting edge extends a fixed lateral distance from the guide plane so that the distal tip of the cutting edge extends over but not beyond a spline channel in the matched type of screen frame when the first edge of the tool is pressed against an outer edge of the matched type of screen frame.

2. The tool of claim 1 wherein the distal tip of the cutting edge extends to proximate a center of the spline channel in the matched type of screen frame when the first edge of the tool is pressed against the outer edge of the matched type of screen frame.

3. The tool of claim 1 wherein the body has a width of 1-3 inches and a length of 1.5-4 inches.

4. The tool of claim 3 wherein the first edge has a length of approximately 2-3 inches.

5. The tool of claim 4 wherein the first edge is 0.1-0.3 inches in height and the sharp extends laterally outward from proximate a transverse center of the first edge.

6. The tool of claim 5 wherein the sharp extends a lateral distance of 0.5-1 inch beyond the guide plane.

7. The tool of claim 1 wherein the sharp is releasably secured to the body.

8. The tool of claim 7 wherein the sharp is releasably secured to the body by a hand actuatable leaf spring detent.

9. The tool of claim 1 wherein the sharp has transversely spaced upper and lower major surfaces, and the tool further includes a protective guard extending laterally from the body over an upper major surface of the sharp without covering a distal end portion of the sharp.

10. The tool of claim 9 wherein the cutting edge extends 0.1-0.4 inches beyond a distal end of the protective guard.

11. The tool of claim 9 wherein the body and protective guard are formed as a single unitary piece.

12. The tool of claim 1 further comprising a tab extending longitudinally outward from the third edge of the body and having a rounded outward facing edge and a point projecting laterally from the tab.

13. The tool of claim 12 wherein the point laterally projects beyond the guide plane.

14. The tool of claim 13 further comprising a recess in a first major surface of the body proximate the tab, configured and arranged for ergonomically cradling a user's thumb.

15. The tool of claim 12 wherein the outward facing edge of the tab is operable for contacting and pressing spline into a spline channel on a screen frame.

16. The tool of claim 12 wherein the point on the tab is operable for initiating removal of spline from a spline channel on a screen frame.

17. A screen repair kit, comprising:

(a) insect screen, and (b) a tool according to claim 1.

18. The screen repair kit of claim 17 further comprising insect screen spline.

19. A method of installing insect screen onto screen frame, comprising the steps of:

(a) placing insect screen over a framed opening and peripheral spline channel defined by a screen frame, with excess insect screen extending beyond the periphery defined by the spline channel of the screen frame, (b) pressing screen spline and associated insect screen into the spline channel in the screen frame so as to capture a periphery of the insect screen within the spline channel, (c) trimming excess insect screen from around the frame by (i) placing the excess insect screen projecting from the spline channel under tension, (ii) pressing the first edge of a tool in accordance with claim 1 against an exterior edge of the screen frame with the sharp projecting towards and into operable slicing engagement with tensioned excess insect screen projecting from the spline channel, and (ii) sliding the tool along the exterior edge of the screen frame with the first edge pressed against the exterior edge of the screen frame and the sharp projecting into and slicing tensioned excess insect screen projecting from the spline channel.

20. A method of repairing insect screen on a screen frame, comprising the steps of:

(a) removing spent insect screen from the screen frame by:

(i) removing a length of insect screen spline from a spline channel of a screen frame using the point on a tool in accordance with claim 12, (ii) pulling the balance of the insect screen spline from the spline channel on the screen frame, (iii) separating the spent insect screen from the screen frame, and (b) installing replacement insect screen onto the screen frame by:

(c) placing replacement insect screen over the framed opening and peripheral spline channel defined by the screen frame, with excess replacement insect screen extending beyond the periphery defined by the spline channel of the screen frame, (d) pressing screen spline and associated replacement insect screen into the spline channel in the screen frame so as to capture a periphery of the replacement insect screen within the spline channel, and (e) trimming excess replacement insect screen from around the screen frame by (i) placing the excess replacement insect screen projecting from the spline channel under tension, (ii) pressing the first edge of the tool against an exterior edge of the screen frame with the sharp projecting towards and into operable slicing engagement with tensioned excess replacement insect screen projecting from the spline channel, and (ii) sliding the tool along the exterior edge of the screen frame with the first edge pressed against the exterior edge of the screen frame and the sharp projecting into and slicing tensioned excess replacement insect screen projecting from the spline channel.

21. The method of claim 20 wherein the screen spline is pressed into the spline channel by pressing the screen spline towards the spline channel with the rounded outward facing edge of the tab on the tool.

* * * * *